US009763485B1

(12) United States Patent
Weitala

(10) Patent No.: US 9,763,485 B1
(45) Date of Patent: Sep. 19, 2017

(54) WATERPROOF STADIUM BLANKET CONVERTIBLE TO A FITTED BODYWRAP HOODIE

(76) Inventor: Denise Weitala, Mahtomedi, MN (US)

( * ) Notice: Subject to any disclaimer, the term of this patent is extended or adjusted under 35 U.S.C. 154(b) by 1157 days.

(21) Appl. No.: 13/044,867

(22) Filed: Mar. 10, 2011

Related U.S. Application Data

(60) Provisional application No. 61/317,845, filed on Mar. 26, 2010.

(51) Int. Cl.
*A41D 15/04* (2006.01)

(52) U.S. Cl.
CPC ..... *A41D 15/04* (2013.01)

(58) Field of Classification Search
CPC ..... A41D 15/04
USPC ..... 5/482, 484, 485, 486, 496, 413 R, 417, 5/419, 420; 2/69, 69.5, 84
See application file for complete search history.

(56) References Cited

U.S. PATENT DOCUMENTS

| | | | | | |
|---|---|---|---|---|---|
| 1,825,520 | A * | 9/1931 | Grunfeld | 2/69 |
| 2,611,899 | A * | 9/1952 | Nelson | 2/69.5 |
| 3,835,471 | A * | 9/1974 | Lankford | 2/84 |
| 4,142,264 | A * | 3/1979 | Whiting | 5/482 |
| 4,217,662 | A * | 8/1980 | Buchman | 2/69.5 |
| 4,484,362 | A * | 11/1984 | Asher | 2/69 |
| 4,752,971 | A * | 6/1988 | Meserol | 2/88 |
| 5,443,880 | A * | 8/1995 | Wike | 428/78 |
| 5,769,106 | A * | 6/1998 | Achuff | 135/95 |
| 5,884,331 | A | 3/1999 | Barajas | |
| 5,946,723 | A * | 9/1999 | DiPrato et al. | 2/88 |
| 6,353,933 | B1 * | 3/2002 | Love | 2/88 |
| 6,393,637 | B1 * | 5/2002 | Hoffman | 5/413 R |
| 6,393,638 | B1 * | 5/2002 | MacColl | 5/419 |
| 6,643,870 | B2 * | 11/2003 | Bertrand | 5/482 |
| 6,845,518 | B1 * | 1/2005 | Boesen | 2/86 |
| 6,966,069 | B2 * | 11/2005 | Booth | 2/69 |
| 2007/0169247 | A1 * | 7/2007 | Mordecai et al. | 2/81 |
| 2008/0054032 | A1 * | 3/2008 | Jones | 224/156 |
| 2008/0083066 | A1 * | 4/2008 | Linn et al. | 5/485 |
| 2010/0325771 | A1 * | 12/2010 | Gandy | 2/84 |
| 2011/0179548 | A1 * | 7/2011 | Weston | 2/84 |
| 2011/0258749 | A1 * | 10/2011 | Hibbs | 2/84 |

OTHER PUBLICATIONS http://www.yourblanketsite.com, 2005.
http://www.chilloutblankets.com, 2009.

* cited by examiner

*Primary Examiner* — Robert G Santos
*Assistant Examiner* — Myles Throop
(74) *Attorney, Agent, or Firm* — Sherrill Law Offices, PLLC

(57) ABSTRACT

A blanket convertible into an article of clothing and a method of using the blanket for protection against the elements by converting the blanket into an article of clothing and donning the article of clothing. The blanket is a planar expanse, having an inner layer of a thermal insulating textile, and an outer layer of a water repellant or waterproof material. A first fastening device is configured and arranged on the expanse within an upper margin for user selective attachment of laterally spaced portions of the upper margin to one another to form a neck opening. A second fastening device is configured and arranged on the expanse within at least one side margin proximate a lower margin for user selective attachment of the side margins to one another.

10 Claims, 10 Drawing Sheets

WATERPROOF STADIUM BLANKET CONVERTIBLE TO A FITTED BODYWRAP HOODIE

This application claims the benefit of U.S. Provisional Application No. 61/317,845, filed Mar. 26, 2010.

BACKGROUND

Campers and outdoor sports fans often encounter wet and/or cold conditions. Those with experience will bring a blanket to sit on for cushioning, a blanket to wear for thermal protection and a waterproof jacket and/or pants. However, such equipment is bulky.

Accordingly, a need exists for a single thermally insulated and waterproof article capable of functioning as a blanket and an article of clothing.

SUMMARY OF THE INVENTION

A first aspect of the invention is a blanket convertible into an article of clothing. The blanket is a planar expanse, having (i) longitudinally spaced upper and lower margins, (ii) laterally spaced first and second side margins, (iii) an inner layer of a thermal insulating textile, and (iv) an outer layer of a water repellant or waterproof material. A first fastening device is configured and arranged on the expanse within the upper margin for user selective attachment of laterally spaced portions of the upper margin to one another to form a neck opening. A second fastening device is configured and arranged on the expanse within at least one side margin proximate the lower margin for user selective attachment of the side margins to one another.

A second aspect of the invention is a method of protecting a human against the elements by donning the blanket of the first aspect with the upper margin encircling the neck and draped over the shoulders, and attaching the first fastening device.

DETAILED DESCRIPTION OF A PREFERRED EMBODIMENT

Nomenclature

10 Blanket
10*a* Top Edge of Blanket
10*b* Bottom Edge of Blanket
10*r* Right Side Edge of Blanket
10*s* Left Side Edge of Blanket
11 Interior Thermal Layer
12 Exterior Waterproof Layer
18*r* Right Pocket
18*s* Left Pocket
19 Hood Storage Pouch
19*a* Opening or slit
20 Hood
31 Closure Zipper on Hood Storage Pouch
32 Upper Zipper
32*r* Right Half of Upper Zipper
32*s* Left Half of Upper Zipper
33 Lower Zipper
33*r* Right Half of Lower Zipper
33*s* Left Half of Lower Zipper
41 Head Opening in Form Fitted Blanket
42 Arm Opening in Form Fitted Blanket
43 Leg Opening in Form Fitted Blanket
50 Elastic Storage Band

A Specific Preferred Embodiment

Figure 1:
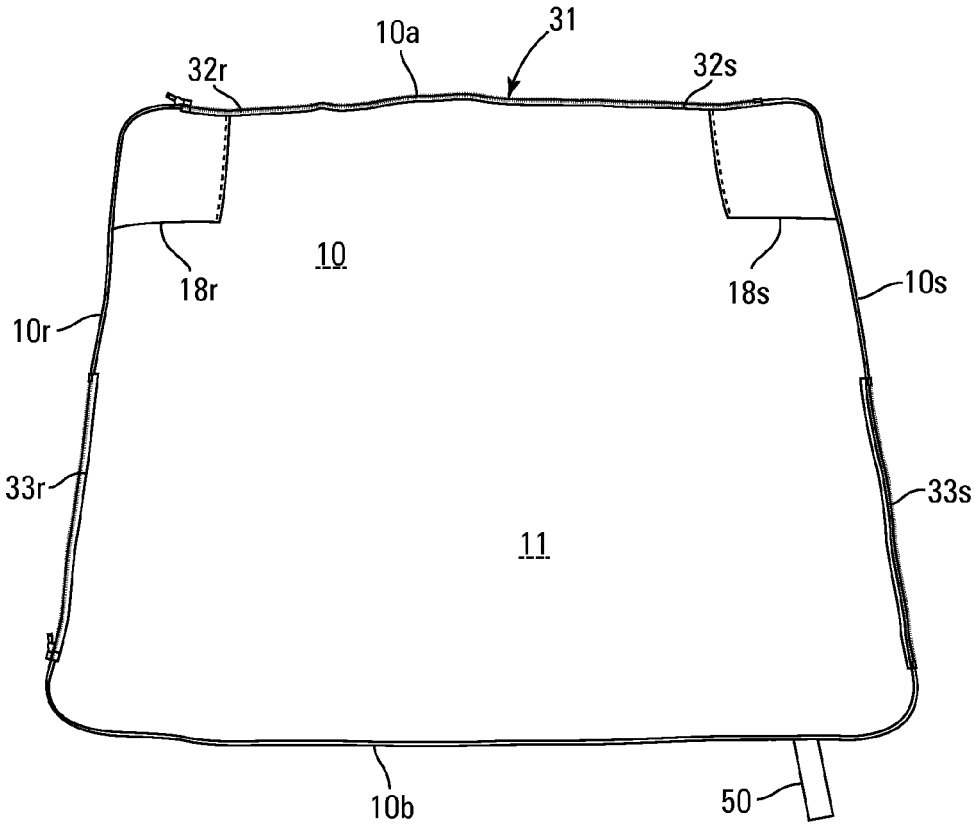
FIG. 1 is a top perspective view of one embodiment of the present invention deployed as a picnic blanket.
Figure 2:
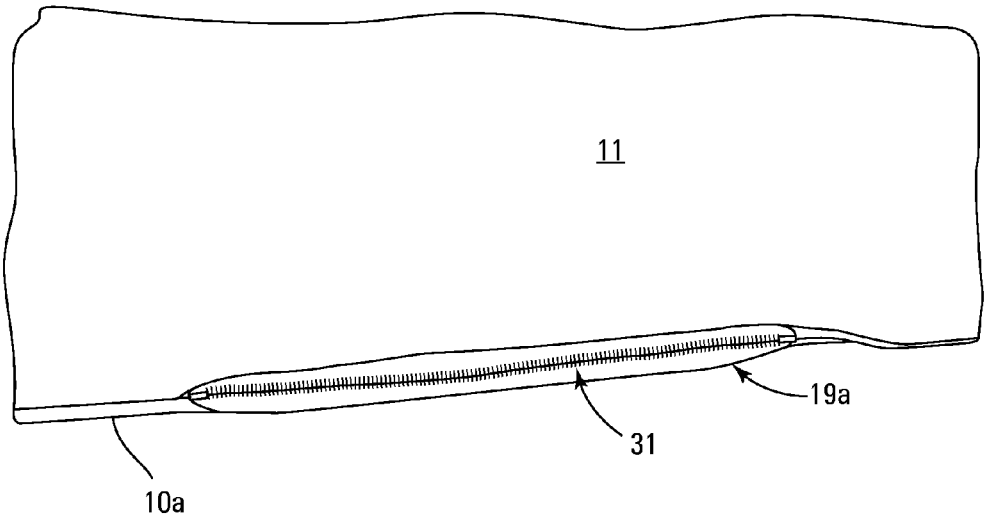
FIG. 2 is an enlarged view of the hood storage pouch closure zipper along the top edge of the invention depicted in FIG. 1.
Figure 3A:
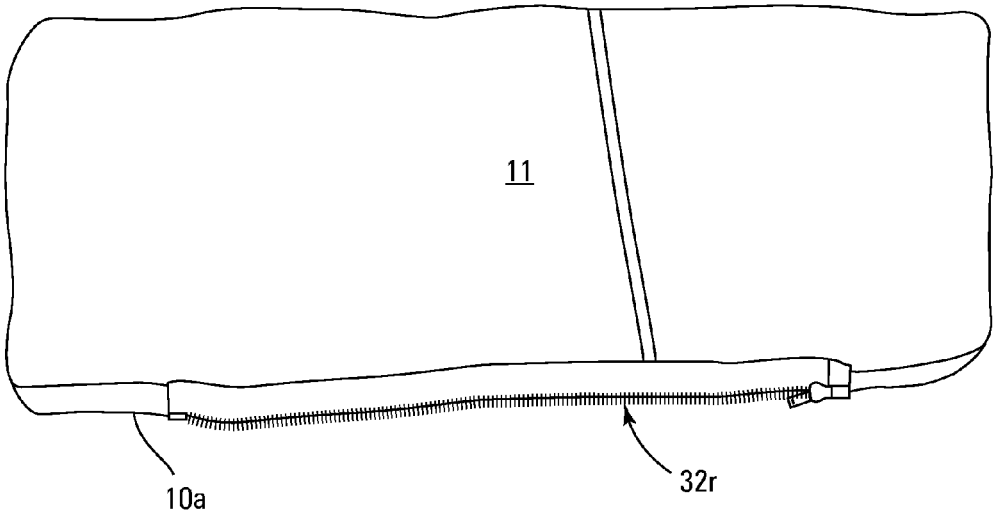
FIG. 3*a* is an enlarged view of the right half of the upper zipper along the top edge of the invention depicted in FIG. 1.
Figure 3B:
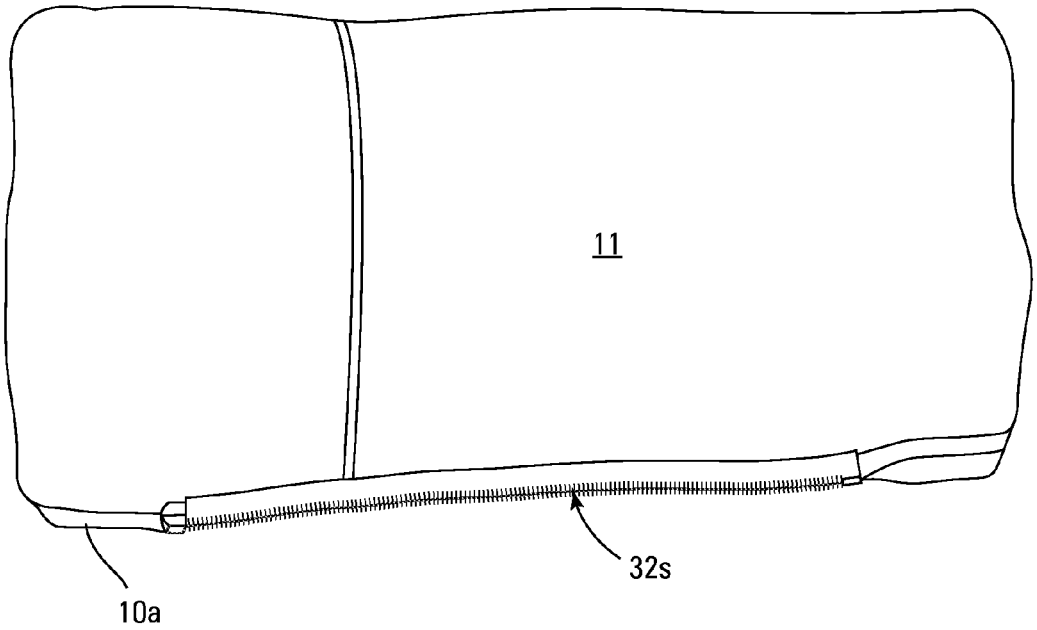
FIG. 3*b* is an enlarged view of the left half of the upper zipper along the top edge of the invention depicted in FIG. 1.
Figure 4A:
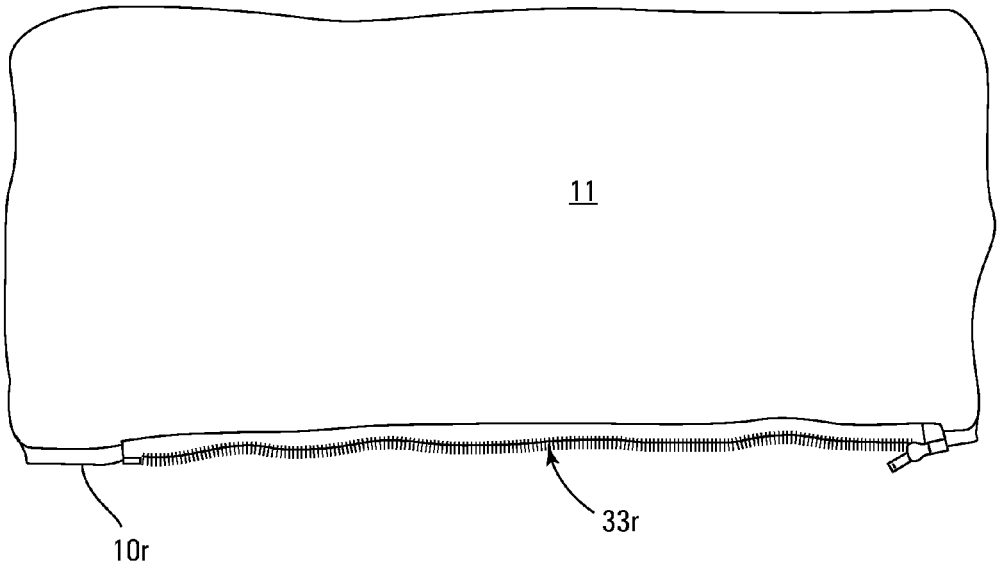
FIG. 4*a* is an enlarged view of the right half of the lower zipper along the right side edge of the invention depicted in FIG. 1.
Figure 4B:
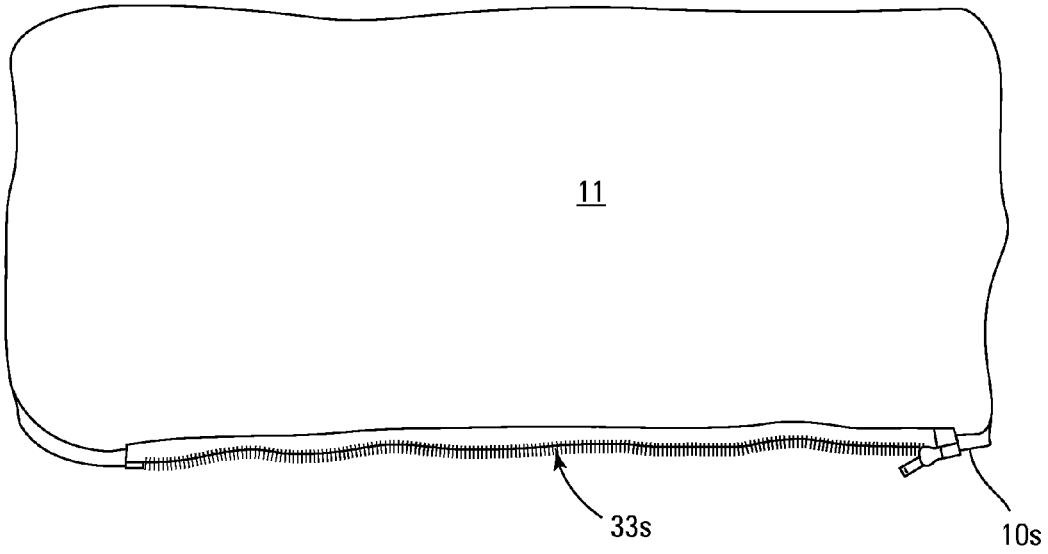
FIG. 4*b* is an enlarged view of the left half of the lower zipper along the left side edge of the invention depicted in FIG. 1.
Figure 5:
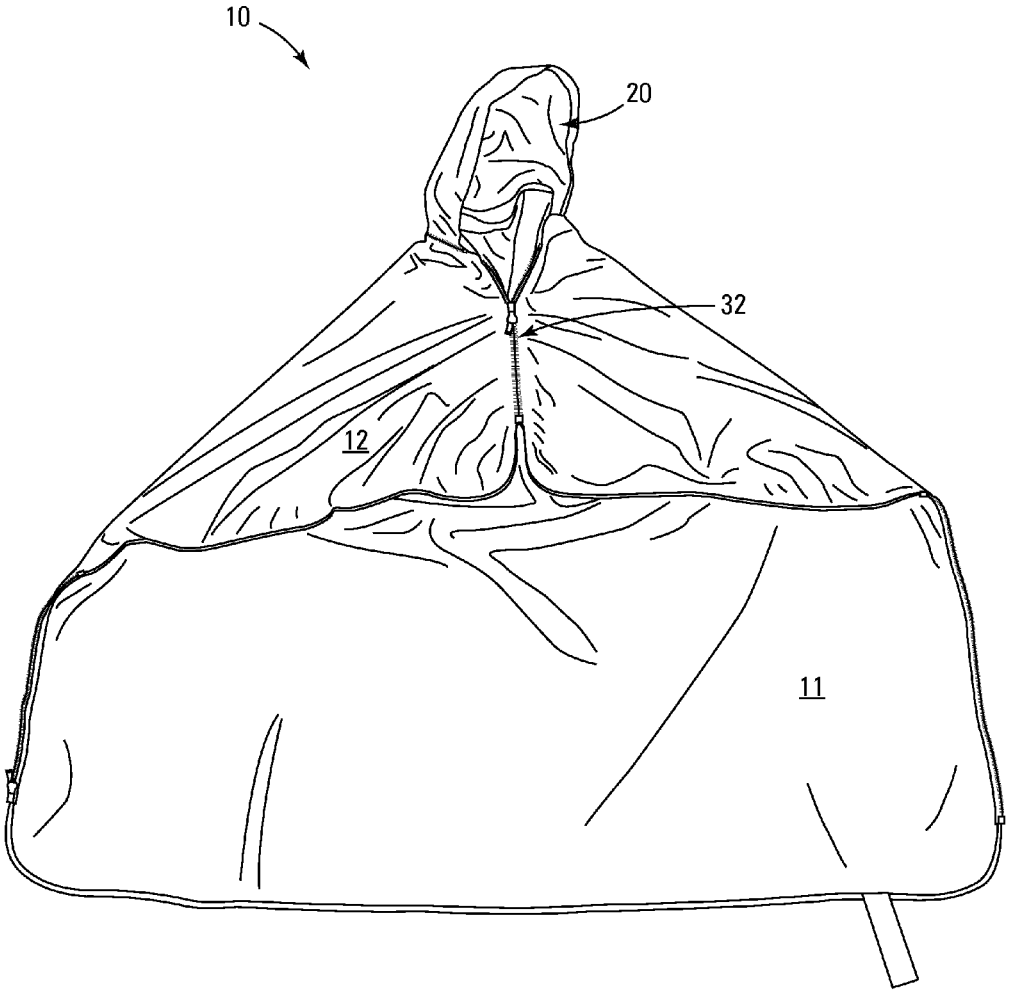
FIG. 5 is a top perspective view of the invention depicted in FIG. 1 with the hood removed from the pouch and the upper zipper halves zipped together.
Figure 6:
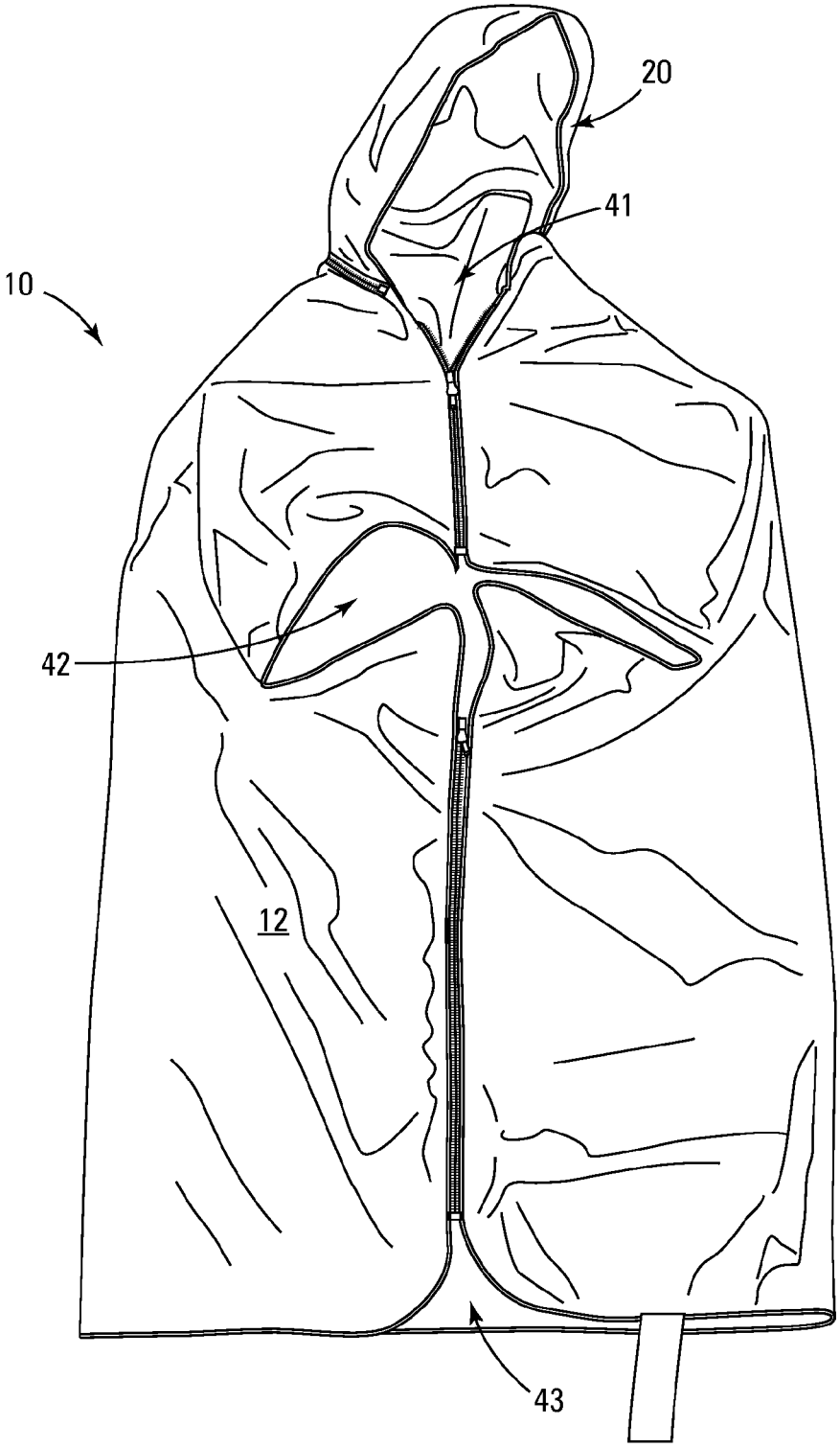
FIG. 6 is a top perspective view of the invention depicted in FIG. 5 with the lower zipper halves zipped together.
Figure 7:
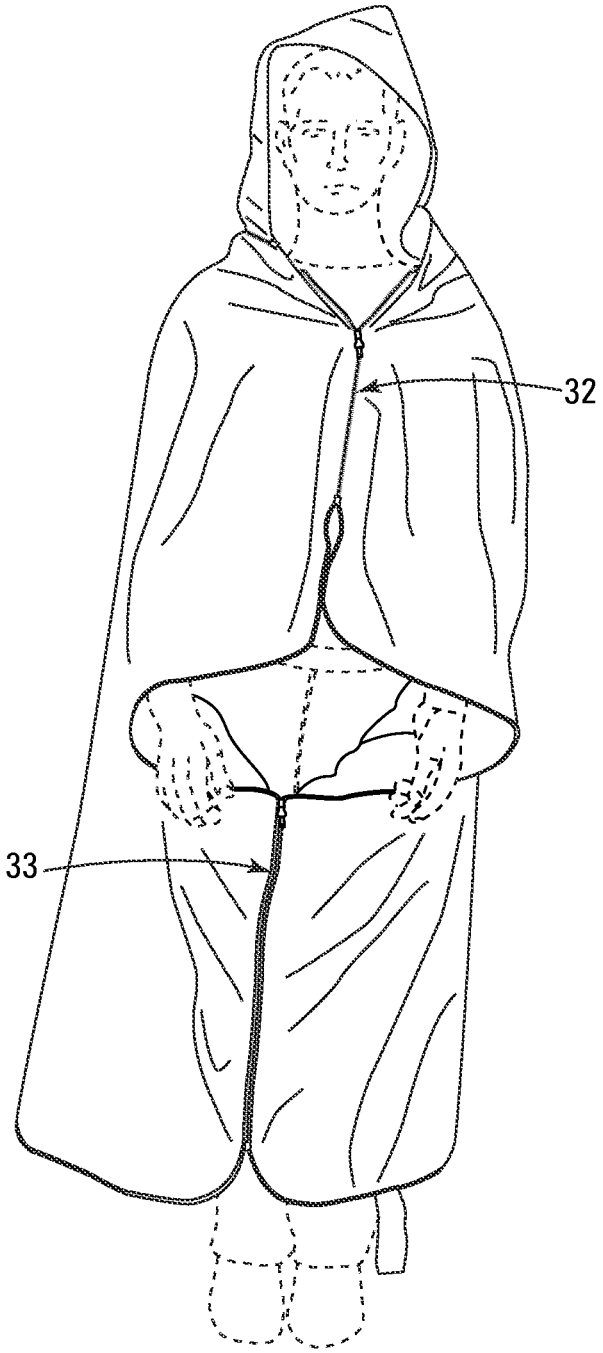
FIG. 7 is a front view of a person wearing the invention depicted in FIG. 1 with the hood removed from the pouch, the upper zipper zipped together and the lower zipper zipped together.
Figure 8:
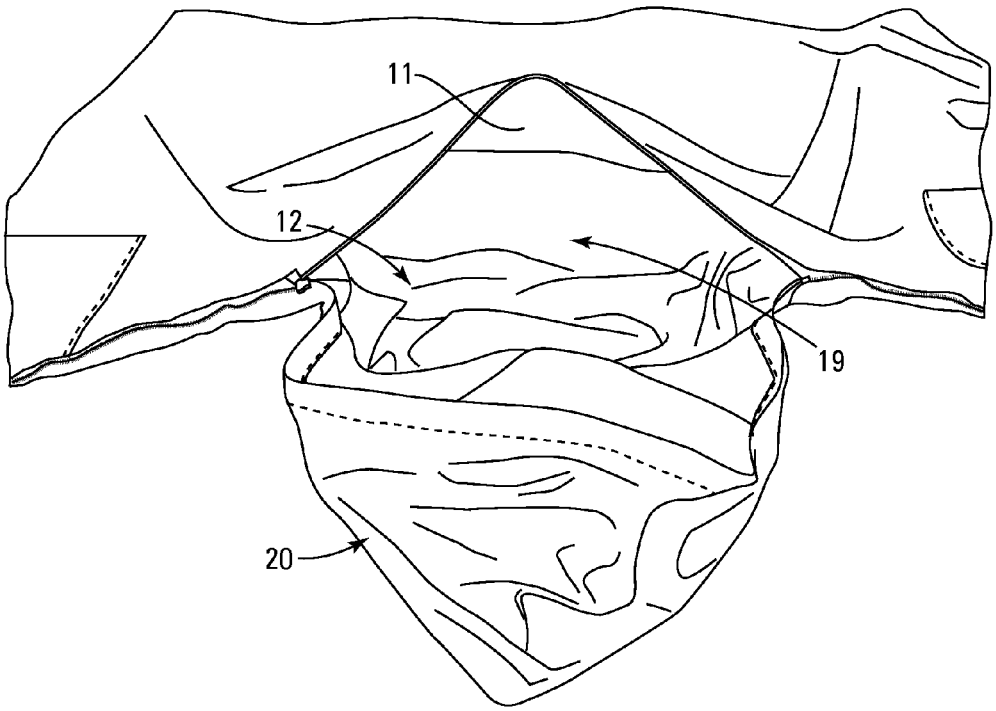
FIG. 8 is a top edge perspective view of the invention depicted in FIG. 1 with the hood removed from the pouch and the pouch held open.

Referring to FIGS. 1-8, a blanket 10 is disclosed. The blanket 10 can be used as a picnic blanket on the ground, or as a hooded or non-hooded cape or coverlet. Zippers 32 and 33 close the front upper and lower sections of the blanket 10 respectively so the blanket 10 stays hanging over shoulders without having to hold it in place.

This blanket 10 can be constructed with an inner layer 11 of a soft woven fleece, flannel or similar textile, and an outer layer 12 of nylon or other water repellant or waterproof textile. The blanket 10 is preferably a rectangle, approximately 5 feet by 4 feet. Sizes may vary to accommodate children and large adults. The inner 11 and outer 12 layers of the blanket 10 are joined together using either a binding or bias tape (unnumbered). The binding or bias tape is preferably a material similar to the outer layer. Alternatively the edges 10*a*, 10*b*, 10*r* and 10*s* may be joined by folding the outer layer 12 over the inner layer 11 and stitching it in place. The edges 10*a*, 10*b*, 10*r* and 10*s* of the blanket corners (unnumbered) preferably have a radius to allow for easy manufacturing if a binding is used.

A hood 20 is preferably sewn to the outer layer 12 of the blanket 10 proximate the middle of the top edge 10*a* of the blanket 10. An opening or slit 19*a* into the space between the layers 11 and 12 is provided along the top edge 10*a* to form a pouch 19 into which the hood 20 may be stored. The hood 20 is preferably made with the same inner 11 and outer 12 layers as the blanket 10. A closure zipper 31 is sewn into the opening.

An upper zipper 32 is located along the top edge 10*a* of the blanket 10 on either side of the hood 20. When the blanket 10 is placed over the shoulders, this zipper 32 connects the two upper corners (unnumbered) in front, creating an enclosed "cape" over the chest area. On the inside of the chest area, approximately 6 inch pockets 18*r* and 18*s* are provided in the inner lining layer 11. The pockets 18*r* and 18*s* are sewn into the lining 11 in a horizontal fashion, ending at the upper zipper 32. The pockets 18*r* and 18*s* keep hands warm and provide a comfortable "resting" place for the forearms.

When the upper area is zippered into a "cape", the rest of the blanket 10 can hang freely down the back and sides of a wearer, or it can be connected in front with a lower zipper 33. The lower zipper 33 has a right half 33*r* along the lower portion of the right side edge 10*r* of the blanket 10 and a left half 33*s* along the lower portion of the left side edge 10*s* of the blanket 10. This zipper 33 can connect the side edges 10*r* and 10*s* of the blanket 10 at the front of the body, enclosing the lower leg area and creating a wrap around or "sleeping bag" effect.

When using the blanket 10 in a seated position, closing the lower zipper 33 protects the top of the legs from cold and moisture as well. The upper part of the zipped blanket 10 "capes" over the middle of the body, protecting that area while in a seated position.

Fastening devices other than zippers may be employed, such as hook and loop tape, snaps, buttons, clasps, magnets, etc.

An elastic strap 50 can be looped and sewn into the binding near one of the corners of the blanket 10, for use in securing a folded and rolled blanket 10. This strap is preferably about 12 inches long and can also be used as a handle for transporting the blanket 10.

I claim:

1. A blanket convertible into an article of clothing, comprising:

(a) a planar expanse, having and defining when in an unfolded and flat configuration (i) longitudinally spaced upper and lower margins, (ii) laterally spaced first and second side margins, (iii) an inner layer of a thermal insulating textile, and (iv) an outer layer of a water repellant or waterproof material, (b) a first fastening device configured and arranged on the expanse within the upper margin for user selective attachment of laterally spaced portions of the upper margin to one another to form a neck opening, (c) a second fastening device configured and arranged on the expanse within at least one side margin proximate the lower margin for user selective attachment of the side margins to one another to form an arm opening, and (d) a pocket on the inner layer proximate the intersection of each side margin with the upper margin, each pocket accessible from an end of the pocket distal from the upper margin.

2. The blanket of claim 1 further comprising, (i) a laterally centered laterally elongated slit within the upper margin flanked by the laterally spaced portions of the upper margin and in spatial communication with a pouch defined between the inner and outer layers, and (ii) a hood attached to the expanse proximate the slit configured and arranged for selective insertion into the pouch for hidden storage and withdrawal from the pouch for use as a hood.

3. The blanket of claim 2 further comprising a third fastening device configured and arranged for user selective opening and closing of the slit.

4. The blanket of claim 1 wherein the first fastening device is a zipper with a first set of teeth extending along an edge of the upper margin on one side of the hood and a second set of teeth extending along the edge of the upper margin on the other side of the hood.

5. The blanket of claim 1 wherein the second fastening device is a zipper with a first set of teeth extending along an edge of the first side margin and a second set of teeth extending along the edge of the second side margin.

6. The blanket of claim 3 wherein the third fastening device is a zipper.

7. A method of protecting against the elements, comprising the steps of:

(a) donning the blanket of claim 1 with the upper margin encircling the neck and draped over the shoulders of a wearer, and (b) attaching the first fastening device.

8. The method of claim 7 further comprising the step of attaching the second fastening device after donning the blanket whereby the lower margin encircles the legs of a wearer.

9. A method of protecting against the elements, comprising the steps of:

(a) obtaining the blanket of claim 2, (b) removing the hood from the pouch, (c) donning the blanket with the upper margin encircling the neck and draped over the shoulders of a wearer, (d) attaching the first fastening device, and (e) placing the hood over the head of a wearer.

10. A method of protecting against the elements, comprising the steps of:

(a) obtaining the blanket of claim 1, (b) donning the blanket with the upper margin encircling the neck and draped over the shoulders of a wearer, (c) attaching the first fastening device, and (d) inserting at least one hand of the wearer into one of the pockets.

* * * * *